United States Patent [19]

Fujiwara et al.

[11] Patent Number: 4,977,136

[45] Date of Patent: Dec. 11, 1990

[54] COVER FILM FOR HARD COPY PRINTING PAPER

[75] Inventors: Yoshio Fujiwara; Naotake Kobayashi; Satoru Shinohara; Tetsuya Abe, all of Kanuma, Japan

[73] Assignee: Sony Corporation, Tokyo, Japan

[21] Appl. No.: 406,196

[22] Filed: Oct. 4, 1989

Related U.S. Application Data

[63] Continuation of Ser. No. 130,944, Dec. 10, 1987, abandoned, which is a continuation of Ser. No. 817,737, Nov. 29, 1985, abandoned.

[30] Foreign Application Priority Data

Mar. 29, 1984 [JP] Japan ..... 59-61853

[51] Int. Cl.[5] ..... B41M 5/035; B41M 5/26

[52] U.S. Cl. ..... 503/227; 8/471; 428/203; 428/419; 428/475.5; 428/475.8; 428/480; 428/483; 428/500; 428/913; 428/914

[58] Field of Search ..... 8/471; 428/195, 201, 428/204, 475.5, 480, 522, 532, 913, 914, 203, 419, 475.8, 483, 500; 503/227

[56] References Cited

FOREIGN PATENT DOCUMENTS 0101744 9/1983 European Pat. Off. ..... 503/227
0103024 3/1984 European Pat. Off. ..... 503/227

*Primary Examiner*—Bruce H. Hess
*Attorney, Agent, or Firm*—Hill, Van Santen, Steadman & Simpson

[57] ABSTRACT

The present invention relates to a cover film for hard copy printing paper which can easily form a colorless and transparent protecting layer on the surface of, for example, a printing paper on which a color picture image is printed. The cover film for hard copy printing paper is such one that the cover film for hard copy printing paper is formed on the surface of a hard copy printing paper on which the printing is carried out by the sublimation transfer method and the cover film is designed to include at least one layer the glass transition temperature of which is selected to be higher than 40° C. and whose water absorbing ratio (ASTM D570) is selected to be lower than 2%, whereby even under high temperature and high humidity, the bad influence exerted by the movement of a dye can be removed.

3 Claims, 3 Drawing Sheets

FIG. 2A

| | Carrier Surface Side / Printing Paper Surface Side | Glass Transition Temperature (°C) | Water Absorbing Ratio (%) | Temperature 40°C Relative Humidity 95% One Week | Temperature 65°C Relative Humidity 80% One Week |
|---|---|---|---|---|---|
| (Comparative Example 1) | Polyvinylidene Choloride Manufactured by Asahi Dow Chemical Co., Ltd. (SARAN RESIN R202) | 0 | Lower than 0.1 | × | × |
| | Internally-Plasticized Polyester Resin Manufactured by Toyobo Co., Ltd. (VYLON #300) | 7 | 0.8 | | |
| (Comparative Example 2) | Nylon 6-System Resin Manufactured by Toray Industries Inc. (NYLON CM8000) | 40 | 3.5 | × | × |
| (Comparative Example 3) | Cellulose Acetate Butyrate Manufactured by Bayer A·G· (Cellidor BH) | 120 | 2.4 | × | × |
| | Internally-Plasticized Polyester Resin Manufactured by Toyobo Co., Ltd. (VYLON #300) | 7 | 0.8 | | |
| (Example 1) | Polysulfonic Resin Manufactured by Nissan Chemical Industries Co., Ltd. (POLYSULFON P1700NT) | 190 | 0.3 | ○ | ○ |
| | Internally-Plasticized Polyester Resin Manufactured by Toyobo Co., Ltd. (VYLON #300) | 7 | 0.8 | | |

FIG. 2A
FIG. 2B

FIG. 2B

| | | | | | |
|---|---|---|---|---|---|
| (Example 2) | Polystyrene Resin Manufactured by Asahi Dow Chemical Co., Ltd. (STYRON 660) | 100 | 0.05 | ○ | ○ |
| | NYLON CM8000 | 40 | 3.5 | | |
| (Example 3) | SARAN RESIN R202 | 0 | Lower than 0.1 | ○ | × |
| | Internally-Plasticized Polyester Resin Manufactured by Toyobo Co., Ltd. (VYLON #300) | 47 | 0.8 | | |
| (Example 4) | Cellulose Acetate Butyrate Manufactured by Bayer A·G· (Cellidor BH) | 120 | 2.4 | ○ | ○ |
| | Polymethyl Methacrylate Resin Manufactured by Rhome & Hearth Co., Ltd. (PARALLOID A-11) | 100 | 0.4 | | |
| | Internally-Plasticized Polyester Resin Manufactured by Toyobo Co., Ltd. (VYLON #300) | 7 | 0.8 | | |
| (Example 5) | Phenoxy Resin Manufactured by Tohoto Kasei Co., Ltd. (PHENO TOHTO YP-50) | 100 | 1.5 | ○ | ○ |
| | Ethyl Cellulose Resin Manufactured by Hercuries Co., Ltd. (ETHYL CELLULOSE N) | 43 | 5 | | |

COVER FILM FOR HARD COPY PRINTING PAPER

This is a continuation of application Ser. No. 130,944, filed Dec. 10, 1987, now abandoned, which is a continuation of application Ser. No. 817,737, filed Nov. 29, 1985, now abandoned.

TECHNICAL FIELD

The present invention relates to a cover film for hard copy printing paper which can easily form a colorless and transparent protecting film on the surface of a printing paper on which the printing was carried out. More particularly, this invention relates to a cover film for hard copy printing paper which can form, on the surface of a color copy that is made by transferring dye from a dye carrier paper made by using a sublimation dye to a printing paper, a protecting layer by heating and pressing a base material having thickness and strength relatively easy to handle to thereby transfer therefrom a thin and transparent resinuous layer impervious to ultraviolet rays which avoids color fading and evidences less curl.

BACKGROUND ART

Generally a printing using a color hard copy printing paper is carried out, in which a dye carrier paper coated with an ink made of a sublimation dye by heating with a thermal print head to sublimate the dye formed on the necessary portion, whereby a color picture image is formed on the printing paper.

However, the picture image formed by this sublimation transfer method has the following problems.

Although at first the sublimated dye is adsorbed by the surface of the printing paper, it is not diffused well so that a portion of the dye may remain as an aggregate, and hence the sublimated dye can not be developed as intended.

Further, the dye is again aggregated, crystallized, and discolored or the dye is transferred to another material and thereby it is smudged To solve these problems, there are proposed in the art the following methods but these methods have their own defects.

(a) As to the method involving coading the printing paper with a resinous liquid, the picture image is blurred. Thus, the printing paper must be dried and the printing paper may not provide a smooth surface. Further, the resinous liquid is troublesome to handle.

(b) When a method of laminating a polyethylene terephthalate film having a hot melt adhesive agent layer on the printing paper is employed, the film becomes easy to curl, to absorb dusts, or to be bent or the adhesive agent is apt to spread excessively. Further, if set incorrectly upon laminating, the laminating apparatus is smudged or the film is caught in the laminating apparatus and thus the handling of this film is cumbersome.

(c) When a method of sandwiching the color hard copy between the polyethylene terephthalate films having a hot melt adhesive agent layer is employed, there may occur problems such as the appearance of the film is damaged and a bubble is produced in the film by the water component contained in the paper.

To solve these problems, there has been proposed a transfer type thin cover film for color hard copy printing paper.

However, since this cover film for color hard copy printing paper is thin, there occur troubles that when the printed color hard copy covered by the cover film is left in the inside of a car in summer, near a window in summer or is used under conditions of high temperature and high humidity, the dye is moved to the surface of the cover film and thereby an album used for preserving pictures and other color picture images is smudged. Although this phenomenon is not yet explained explicitely, it may be considered that a very small amount of dye dissolved or dispersed into the water component in the resin moves readily to the surface of the film together with the water component or that the glass transition temperature of the resin is lowered by the water component.

In view of the above mentioned aspects, the present invention is intended to provide a cover film for hard copy printing paper which can remove bad effects exerted by the transfer of the dye even under the condition of high temperature and high humidity.

DISCLOSURE OF INVENTION

According to the cover film for hard copy printing paper of the present invention, the cover film for hard copy printing paper formed on the surface of the hard copy printing paper printed by sublimation trasfer is designed to include at least one layer that is formed under the conditions that the glass transition temperature is selected to be higher than 40° C. and that the water absorbing ratio (ASTM D570) is selected to be lower than 2% to thereby remove the bad influence exerted by the movement of the dye even at high temperature and high humidity.

BEST MODE FOR CARRYING OUT THE INVENTION

Example 1

Figure 1:
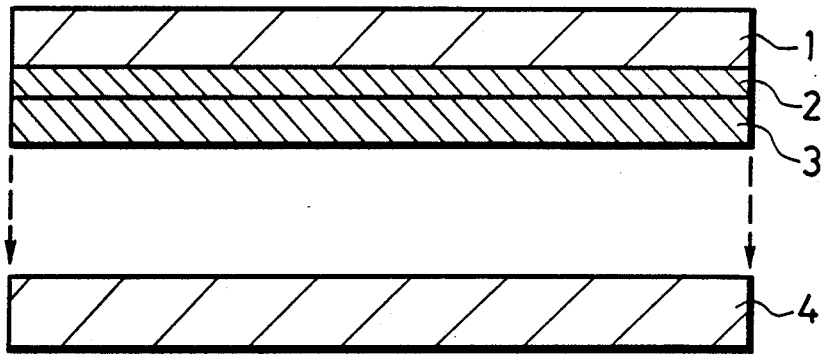
FIG. 1 is a cross-sectional view showing an embodiment of a cover film for hard copy printing paper according to the present invention and FIG. 2 (formed of FIGS. 2A and 2B) is a table useful for explaining the present invention.

First, a color print was formed as follows. A coating composition consisting of 24 parts by weight of internally-plasticized and saturated polyester resin (VYLON #200, manufactured by Toyobo Co., Ltd.), 6 parts by weight of super fine particle silica (NIPSIL E220A, manufactured by Nippon Silica Industrial Co., Ltd.) and 70 parts by weight of methly ethyl ketone solvent was coated on one surface of a free sheet having a basis weight of 170 g/M$^2$ so as to have a coating weight of about 5 g/M$^2$ after being dried, thus a printing paper for sublimation transfer type color hard copy being prepared. A magenta color ink represented by an ink consisting of 6 parts by weight of anthraquinone type dispersion dye (PTR63, manufactured by Mitsubishi Chemical Industries Co., Ltd.) having a sublimation property, 6 parts by weight of ethyl cellulose and 88 parts by weight of isopropyl alcohol solvent was made. Other inks such as cyan color ink, yellow color ink and black color ink were made similarly. Then, they were respectively coated on a paper having a basis weight of 40 g/M$^2$ by using a gravure coater so as to have a coating weight of 5 g/M$^2$ after being dried, thus dye carrier papers of 4 colors were prepared. Then, when the dye carrier paper was heated from the back side thereof by a thermal print head heated at about 300° C., 4 colors were sequentially printed on the above mentioned printing paper, thus a four color print was made.

Next, on a polyethylene terephathalate film 1, 30 μm thick, there were formed polysulfone resin (POLYSULFON P1700NT, manufactured by Nissan Chemical Industries Co., Ltd., whose glass transition temperature and water absorbing ratio were respectively selected to be 190° C. and 0.3%) having a thickness of 5 μm as a first layer 2 and an internally-plasticized polyester resin (VYLON #300, manufactured by Toyobo Co., Ltd.) having a thickness of 10 μm as a second layer 3, thus a cover film for color hard copy printing paper of this example was made. In this case, the water absorbing ratio was measured according to the evaluation method of the ASTM D570 in which a film 0.01 inch thick was immersed into water at 23° C. for 24 hours.

Then, the cover film for color hard copy printing paper was pressed on the color print 4 by using a press plate heated at about 150° C. and the polyethylene terephathalate film 1 as the base material was peeled off therefrom.

Example 2

On a polyethylene terephathalate film 1, 30 μm thick, there were formed the first layer 2 from a polystyrene resin having a thickness of 5 μm (STYRON 660, manufactured by Asahi Dow Chemical Co., Ltd. and the glass transition temperature and water absorbing ratio of which were respectively selected to be 100° C. and 0.05%) and the second layer 3 from nylon having a thickness of 10 μm (CM8000 having a glass transition temperature of 40° C. and a water absorbing ratio of 3.5%), thus a cover film for color hard copy printing paper of this example being made.

The resultant cover film for color hard copy printing paper was pressed on the color print formed the same as that of the example 1 by a press plate heated at about 150° C. and the polyethylene terephthalate film 1 was peeled off.

Example 3

On the polyethylene terephthalate film 1 having a thickness of 30 μm, there were formed the first layer 2 from a poly vinylidenechloride resin (SARAN R202 the glass transition temperature and water absorbing ratio of which were respectively selected to be 0° C. and lower than 0.1%) having a thickness of 5 μm and the second layer 3 from an internally-plasticized polyester resin having a thickness of 10 μm (VYLON #103, manufactured by Toyobo Co., Ltd., and the glass transition temperature and water absorbing ratio of which were respectively selected to be 147° C. and 0.8%), thus a cover film for hard copy printing paper in this example being made.

The resultant cover film for hard copy printing paper was pressed on the color print formed as in the example 1 by using a press plate heated at about 150° C. and the polyethylene terephthalate film 1 was peeled off.

Example 4

On the polyethylene terephthalate film 1 having a thickness of 30 μm, there were formed the first layer 2 from cellulose acetate butyrate having a thickness of 5 μm (Cellidor BH, manufacture by Bayer A. G., and the glass transition temperature and water absorbing ratio of which were respectively selected to be 120° C. and 2.4%), the second layer 3 from polymethyl methacrylate resin having a thickness of 10 μm (Paralloid A-11, manufactured by Rhome and Hearth Co., Ltd., and the glass transition temperature and water absorbing ratio of which were respectively selected to be 100° and 0.8%) and though not shown a third layer from polyester resin (VYLON #300, the glass transition temperature and water absorbing ratio of which were respectively selected to be 7° C. and 0.8%), thus a cover film for color hard copy printing paper being made.

The resultant cover film for hard copy printing paper was pressed on the color print formed the same as in example 1 by using a press plate heated at about 150° C. and the polyethylene terephthalate film 1 was peeled off.

Example 5

On the polyethylene terephthalate film 1 having a thickness of 30 μm, there were formed the first layer 2 from phenoxy resin having a thickness of 5 μm (PHENO TOHTO YP-50, manufactured by Tohto Kasei Co., Ltd., and the glass transition temperature and water absorbing ratio of which were respectively selected to be 190° C. and 1.5%) and the second layer 3 from ethyl cellulose resin (ETHYL CELLULOSE N, manufactured by Hercuries Co., Ltd., and the glass transition temperature and water absorbing ratio of which were respectively selected to be 43° C. and 5%), thus a cover film for color hard copy printing paper in this example being made.

The thus made cover film for color hard copy printing paper was pressed on the color print the same as in example 1 by using the press plate heated at about 150° C. and the polyethylene terephthalate film 1 was peeled off.

To prove the effects of these examples, comparative examples 1, 2 and 3 were made.

Comparative Example 1

On the polyethylene terephthalate film 1 having a thickness of 30 μm, there were formed the first layer 2 from polyvinylidene chloride type resin having a thickness of 5 μm (SARAN RESIN R202, manufactured by Asahi Dow Chemical Co., Ltd., and the glass transition temperature and water absorbing ratio of which were respectively selected to be 0° C. and lower than 0.1%) and the second layer 3 from internally-plasticized polyester resin having a thickness of 5 μm (VYLON #300, manufactured by Toyobo Co., Ltd., and the glass transition temperature and water absorbing ratio of which were respectively selected to be 7° C. and lower than 0.1%), thus a cover film for color hard copy printing paper of this comparative example being made.

The resultant cover film for color hard copy printing paper was pressed on the same color print as that formed in the example 1 by using a press plate heated at about 150° C. and the polyethylene terephthalate film 1 was peeled off.

Comparative Example 2

On the polyethylene terephthalate film 1 having a thickness of 30 μm, there was formed a nylon 6-line resin having a thickness of 5 μm (NYLON CM18000 manufactured by Toray Industries Inc., and the glass transition temperature and water absorbing ratio of which were respectively selected to be 40° C. and lower than 3.5%) thus a cover film for color hard copy printing paper in this comparative example being formed.

The resultant cover film for color hard copy printing paper was pressed on the same color print as that formed in the example 1 by using a press plate heated at about 150° C. and the polyethylene terephthalate film 1 was peeled off.

Comparative Example 3

On the polyethylene terephthalate film 1 having a thickness of 30 μm, there was formed a layer made of cellulose acetate butyrate having a thickness of 5 μm (Cellidor BH, manufactured by Bayer A. G., and the glass transition temperature and water absorbing ratio of which were respectively selected to be 120° C. and 2.4%) as the first layer 2 and a layer made of polyester having a thickness of 10 μm (VYLON #300 the glass transition temperature and water absorbing ratio of which were respectively selected to be 7° C. and 0.8%) as the second layer 3, thus a cover film for color hard copy printing paper in this comparative example being formed.

Then, the resultant cover film for color hard copy printing paper was pressed on the same color print as that formed in the example 1 by using a press plate heated at about 150° C. and the polyethylene terephthalate film 1 was peeled off.

Then, how much of the dye was transferred to the above mentioned comparative example 1, comparative example 2, comparative example 3, and the example 1, example 2, example 3, example 4 and example 5 was evaluated by the method mentioned below.

The treated surface of the printing paper was superposed on the surface of the cover film for color hard copy printing paper. Then, they were sandwiched between perforated plates made of vinyl chloride (the thickness was 2.5 mm, the diameter of hole was 3 mm and the arranging pitch of holes was 7 mm) and thereby applied with a load of 30 g/cm$^2$. Next, a product was subjected to an aging treatment by using atmosphere (the temperature and relative humidity of which were selected to be 40° C. and 95% and, 65° C. and 80%) for one week. After the aging was ended, the treated surface of the printing paper, superposed on the cover film, was observed and checked whether the dye on the surface of the printing paper or the dye used for printing was moved up to the film surface through the cover film for hard copy printing paper or not by eye.

The results will be evaluated with reference to FIG. 2. In FIG. 2, marks ○ indicate the fact that such movement of the dye did not occur and that the cover film for hard copy printing paper could achieve the effect for preventing the dye from being moved. Whereas, marks X indicate the fact that the dye was moved up to the treating surface of the printing paper which was superposed for evaluating the movement of the dye.

As will be clear from FIG. 2, since in the comparative example 1, comparative example 2 and comparative example 3, the resinous layer having the glass transition temperature higher than 40° C. and the water absorbing ratio lower than 2% was not formed on the cover film for color hard copy printing paper in even one layer, the dye was moved. While, since in the example 1, example 2, example 3, example 4 and example 5 the polysulfone resin, the polyethylene resin, the SARAN resin, the polymethyl methacrylate resin and the phenoxy resin respectively satisfied the conditions of the glass transition temperature higher than 40° C. and the water absorbing ratio lower than 2%, it could be considered that the dye was not moved. The reason why the dye was moved in the cover film for color hard copy printing paper made by the example 3 in which the cover film for color hard copy printing paper was subject to the aging treatment for one week under the conditions that the temperature was 65° C. and the relative humidity 85% is that the glass transition temperature of the internally-plasticized polyester resin (VYLON #103, manufactured by Toyobo Co., Ltd) itself is 40° C., which is lower than the temperature for aging treatment. Although the cover film for color hard copy printing paper in this example has a possibility that the dye will be moved when it is used in the inside of a car in summer, it can be used in practice anyhow.

As described above, according to the examples of the present invention, since the cover film for color hard copy printing paper is designed to include a layer having the glass transition temperature higher than 40° C. and the water absorbing ratio lower than 2% (ASTM D570), it is possible to prevent the dye used for printing from being moved up to the surface of the cover film for color hard copy printing paper therethrough. Accordingly, in addition to the ordinary advantages of having a smooth surface, being easy to handle and being able to protect the surface of the printing paper with the thin film, the cover film for color hard copy printing paper has a further advantage that under the conditions of high temperature and high humidity, the dye can be prevented from being moved to the surface of the cover film. The polyethylene terephthalate film 1 as the base material may be a heat-resistant plastic film and can consist of other films, such as polyester film, acetate film, polyimide film, polypropylene film and polyfluorocarbon film. The thickness of the base material is preferally selected in a range from 3 to 100 μm. The thickness of the first layer 2 is preferably selected in a range from 1 to 100 μm and preferably has no adhering property to the base material but the first layer may be treated so as to be peeled off from the base material at its surface on which it is opposed to the base material. The second layer 3 is preferably made of a resin which has high absorbing property for the dye and the second layer can use resins, such as cellulose propionate and the like.

Further, considering the inside of a car and the like in summer, it is more preferable to select the glass transition temperature thereof to be higher than 70° C.

A discoloring agent, an ultra-violet ray absorbent and a phosphor whitener may be added thereto.

It is needless to say that the present invention is not limited to the above-mentioned examples but can take various modifications without departing from the gist of the invention.

We claim:

1. A print comprising a substrate having a visual image formed of sublimation dye on a surface thereof, and a transparent protective cover sheet over said image through a hot-meltable resinous layer provided between said substrate and said protective cover sheet, said protective cover sheet including a layer formed of a material having a glass transition temperature greater than 70° C. and a water absorbing ratio (ASTM D570) of less than 2%, said protective cover film preventing movement of said sublimation dye through said protective cover sheet.

2. The print of claim 1 wherein said hot-meltable resinous layer is selected from the group consisting of internally plasticized polyester resin, nylon resin, ethyl cellulose resin.

3. A print comprising a substrate having a visual image formed of sublimation dye on a surface thereof, and a transparent protective cover sheet over said image through a hot-meltable resinous layer provided between said substrate and said protective cover sheet, said protective cover sheet including a layer formed of a material having a glass transition temperature greater than 70° C. and a water absorbing ratio (ASTM D570) of less than 2%, said protective cover film preventing movement of said sublimation dye through said protective cover sheet, and the material of the layer of the protective cover sheet is selected from the group consisting of polysulfone resin, polystyrene resin, polymethyl methacrylate resin and phenoxy resin.

* * * * *